US008330616B2

(12) United States Patent
Means et al.

(10) Patent No.: US 8,330,616 B2
(45) Date of Patent: Dec. 11, 2012

(54) WELL TEST SYSTEM TO CONTROL WELL PROCESSES BASED ON QUANTITY MEASUREMENTS

(75) Inventors: Stephen R. Means, Bakersfield, CA (US); Mark L. Surber, Bakersfield, CA (US); Mike G. Hagenston, Bakersfield, CA (US); Robert C Riley, Bakersfield, CA (US); Michael E. Crossman, Bakersfield, CA (US); Lee M Britt, Bakersfield, CA (US)

(73) Assignee: FieldVision, Inc., Bakersfield, CA (US)

( * ) Notice: Subject to any disclaimer, the term of this patent is extended or adjusted under 35 U.S.C. 154(b) by 397 days.

(21) Appl. No.: 12/656,988

(22) Filed: Feb. 22, 2010

(65) Prior Publication Data

US 2010/0214120 A1 Aug. 26, 2010

Related U.S. Application Data

(60) Provisional application No. 61/202,388, filed on Feb. 24, 2009.

(51) Int. Cl.
*G01V 3/00* (2006.01)

(52) U.S. Cl. ..... 340/853.3; 340/853.1

(58) Field of Classification Search ..... 340/853.1–853.3
See application file for complete search history.

(56) References Cited

U.S. PATENT DOCUMENTS

| | | | | |
|---|---|---|---|---|
| 3,911,256 | A | 10/1975 | Jones | |
| 4,393,485 | A | 7/1983 | Redden | |
| 4,872,351 | A * | 10/1989 | Ruesch | 73/861.04 |
| 5,554,804 | A * | 9/1996 | Delatorre et al. | 73/152.52 |
| 6,460,622 | B1 | 10/2002 | Rice | |
| 6,464,004 | B1 | 10/2002 | Crawford et al. | |
| 6,615,924 | B2 | 9/2003 | Rice | |
| 6,728,638 | B2 | 4/2004 | Newman | |
| 6,873,267 | B1 | 3/2005 | Tubel et al. | |

(Continued)

FOREIGN PATENT DOCUMENTS

WO WO2006041309 A1 4/2006

OTHER PUBLICATIONS

† Standard FieldVision Net Oil Solution package comprising of a controller with expanded I/O, a power supply, and field-wiring terminal, by FieldVision Inc., 6 pages total, printed Nov. 20, 2008. \ http://field-vision.com/default.htm.

(Continued)

*Primary Examiner* — Peguy Jean Pierre
(74) *Attorney, Agent, or Firm* — Richard C. Litman

(57) ABSTRACT

The well test system has a net oil computer NOC that captures and stores information from disparate well instrumentation devices, measures produced oil, water, and gas quantities based on the information and controls well processes based on the quantity measurements. The NOC includes operational software that collects instrumentation data from a plurality of wells. Configuration software downloads user programmable configuration information to the NOC, which enables the NOC to record data from a wide variety of flow devices, water test meters, or the like. User programmable alarms are included. A plurality of controllers can control processes associated with individual wells. A wireless communication system electronically sends data and test results to cell phones, radio devices, and the like. A daily test data log provides a historical database, which is analyzed to formulate "Data Confidence" information for each well. The net oil computer is operable with two-phase or three-phase separators.

20 Claims, 16 Drawing Sheets

U.S. PATENT DOCUMENTS

| | | | | |
|---|---|---|---|---|
| 6,898,149 | B2 * | 5/2005 | Hill et al. | 367/82 |
| 6,978,210 | B1 | 12/2005 | Suter et al. | |
| 2002/0035551 | A1 | 3/2002 | Sherwin et al. | |
| 2002/0147503 | A1 | 10/2002 | Osburn | |
| 2004/0075566 | A1 | 4/2004 | Stepanik et al. | |
| 2007/0241931 | A1 | 10/2007 | Compton et al. | |
| 2008/0259958 | A1 | 10/2008 | Woo | |

OTHER PUBLICATIONS

Net Oil Computer, by FMC Technologies, "on sale" by Natco Parts, 7 pages total, printed Nov. 20, 2008. http://www.natcoparts.com/catalogue/product/view/prod_id/113 http://www.fmctechnologies.com/upload/ssis009.pdf.

* cited by examiner

WELL TEST SYSTEM TO CONTROL WELL PROCESSES BASED ON QUANTITY MEASUREMENTS

CROSS-REFERENCE TO RELATED APPLICATION

This application claims the benefit of U.S. Provisional Patent Application Ser. No. 61/202,388, filed Feb. 24, 2009.

BACKGROUND OF THE INVENTION

1. Field of the Invention

The present invention relates generally to oil well test equipment and monitoring or control systems, and particularly to a computerized, automatic well test system that captures and stores information from disparate well instrumentation devices, measures the quantities of oil, water, and gas produced by the well based on the information from the instrumentation devices, and controls well processes based on the measurements.

2. Description of the Related Art

A vast majority of today's wells related to the production of hydrocarbons are completed with permanently installed monitoring devices for measuring data such as pressure, temperature, flow rate, flow composition, flow direction, sand and other. In addition, many wells are completed with permanently installed instrumentation and devices in order to enable both remote monitoring and control of that well, eliminating the need for any well intervention. The control devices comprise means for controlling influx of produced fluids (and the out flux of injected fluids) such as valves, sliding sleeves, downhole chokes and similar. Wells that include permanent systems for remote monitoring and control are often referred to as intelligent completions.

A net oil computer utilizes the aforementioned instrumentation systems to calculate information about an unknown fluid, such as a crude oil-saltwater emulsion that flows through, e.g., a coriolis meter, a water-cut meter, a multiphase metering system, or other type of flow and water-cut metering system. A compatibility problem arises when it is desired to move a net oil computer designed to interface with a specific manufacturing brand of flow and water-cut metering system installed in a particular oil field to another field having flow and cut meters designed by another manufacturer. A typical net oil computer simply will not work with instrumentation from a disparate group of manufacturers. What is needed is a well test system having a net oil computer capable of being easily reconfigured for operability with different brands and types of well test instrumentation devices and systems.

Thus, a well test system solving the aforementioned problems is desired.

SUMMARY OF THE INVENTION

The well test system has a net oil computer (NOC) and configuration software enabling the computer to be conveniently programmed to capture and store information from disparate well instrumentation devices. The NOC then measures produced oil, water, and gas quantities based on the information and controls well processes based on the quantity measurements. The system includes operational software that collects instrumentation data from a plurality of wells. The configuration software provides the means for communicating with a wide variety of disparate well instrumentation systems. User programmable alarms are included. The NOC is preferably a supervisory control and data acquisition (SCADA) system, thus facilitating the management of oil and gas energy production operations.

Moreover, the net oil computer has a plurality of controllers for controlling individual wells, performing well diagnostics, and the like. A wireless communication portion of the system electronically sends data and test results to cell phones, radio devices, and the like. Daily test data is logged to provide a historical database, which is analyzed to formulate "Data Confidence" information based upon the historical data associated with previous tests for each well. Additionally, the net oil computer is operable with two-phase or three-phase separators.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a well test system 10 that includes a net oil computer NOC 20 that measures, records, and stores information about production quantities from oil, water, and gas wells. The network oil computer is preferably a supervisory control and data acquisition (SCADA) compliant system. SCADA systems have many uses, including the testing and management of energy production operations.

The net oil computer 20 includes software that, via a plurality of user accessible screens, can be programmed by the user to record data from a wide variety of flow devices, water test meters, or the like. The net oil computer 20 includes programmable alarms and a user interface that allows the alarms to be set by the user. Moreover, the net oil computer 20 has a plurality of controllers for controlling individual wells, performing well diagnostics, and the like. The net oil computer 20 can electronically send well data and test results to cell phones, radio devices, and the like. Daily test data is logged to provide a historical database, which is analyzed to formulate "Data Confidence" information based upon the historical data associated with previous tests for each well. Additionally, the net oil computer is operable with two-phase or three-phase separators.

Figure 1:
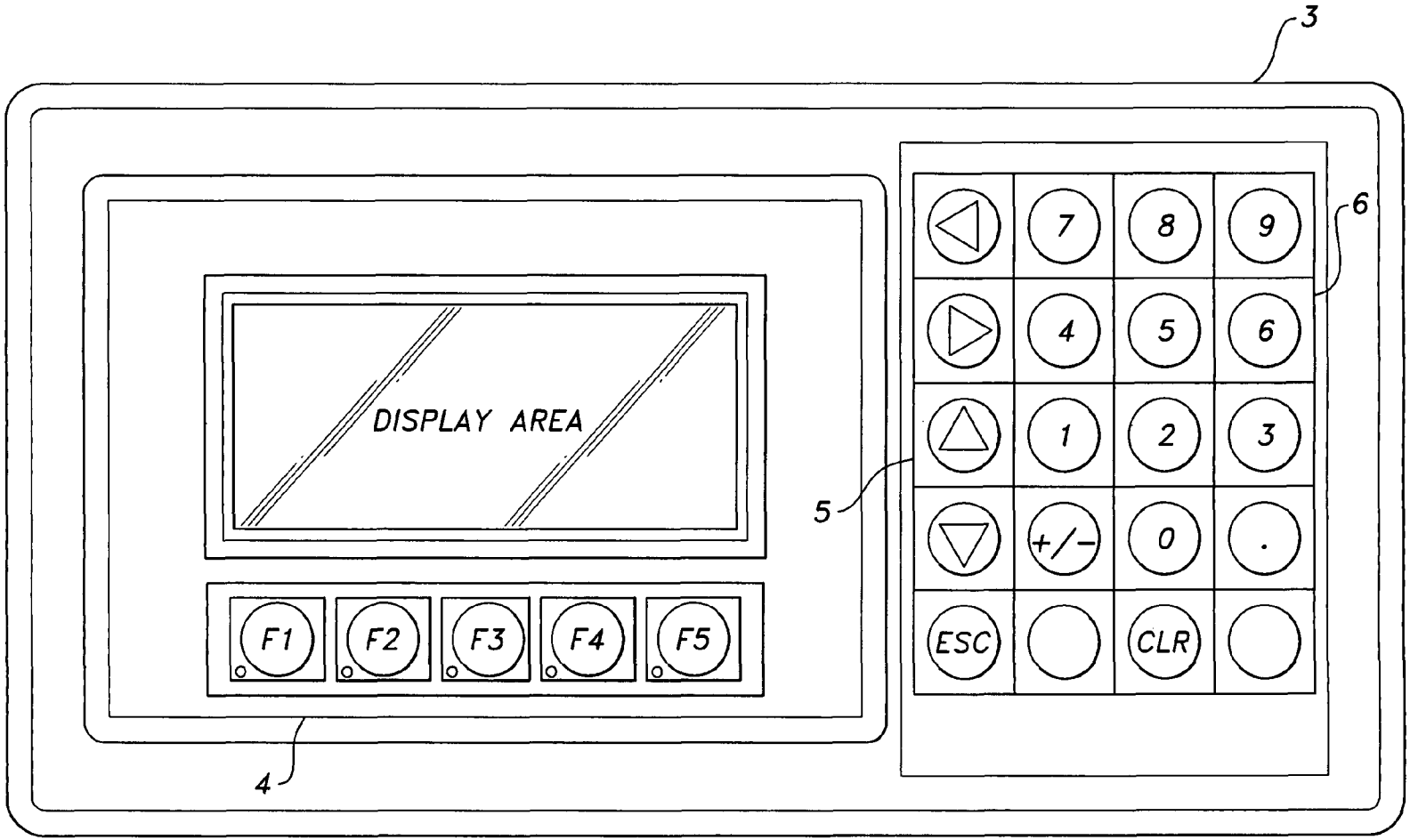
FIG. 1 is a front view of a control panel of the net oil computer in a well test system according to the present invention.
Figure 2:
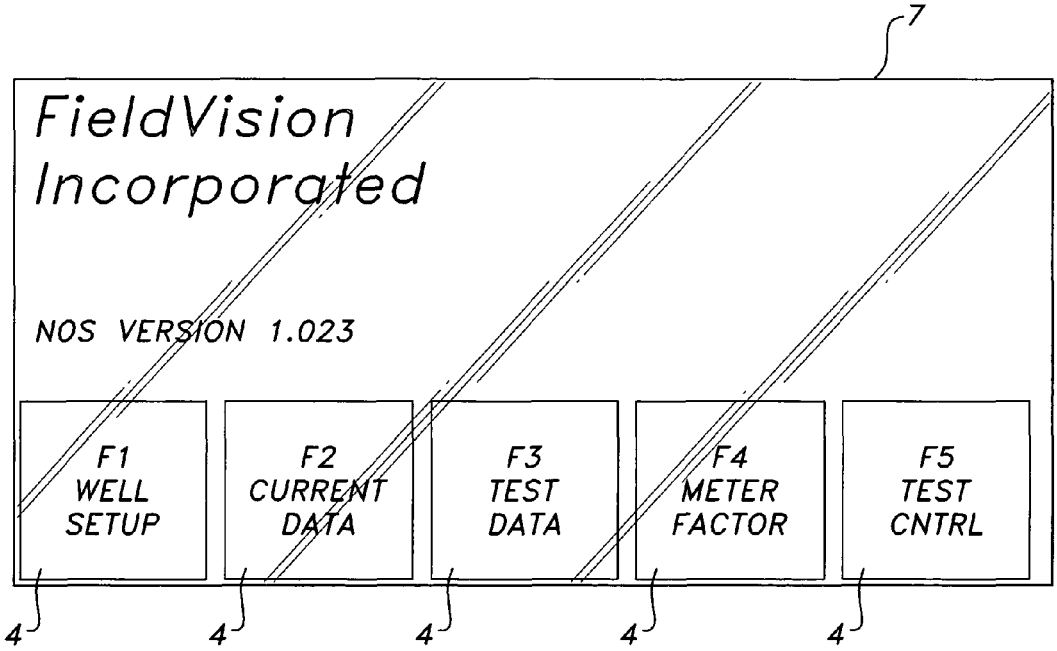
FIG. 2 is a screen shot of a home screen on the control panel of the net oil computer of a well test system according to the present invention.
Figure 3:
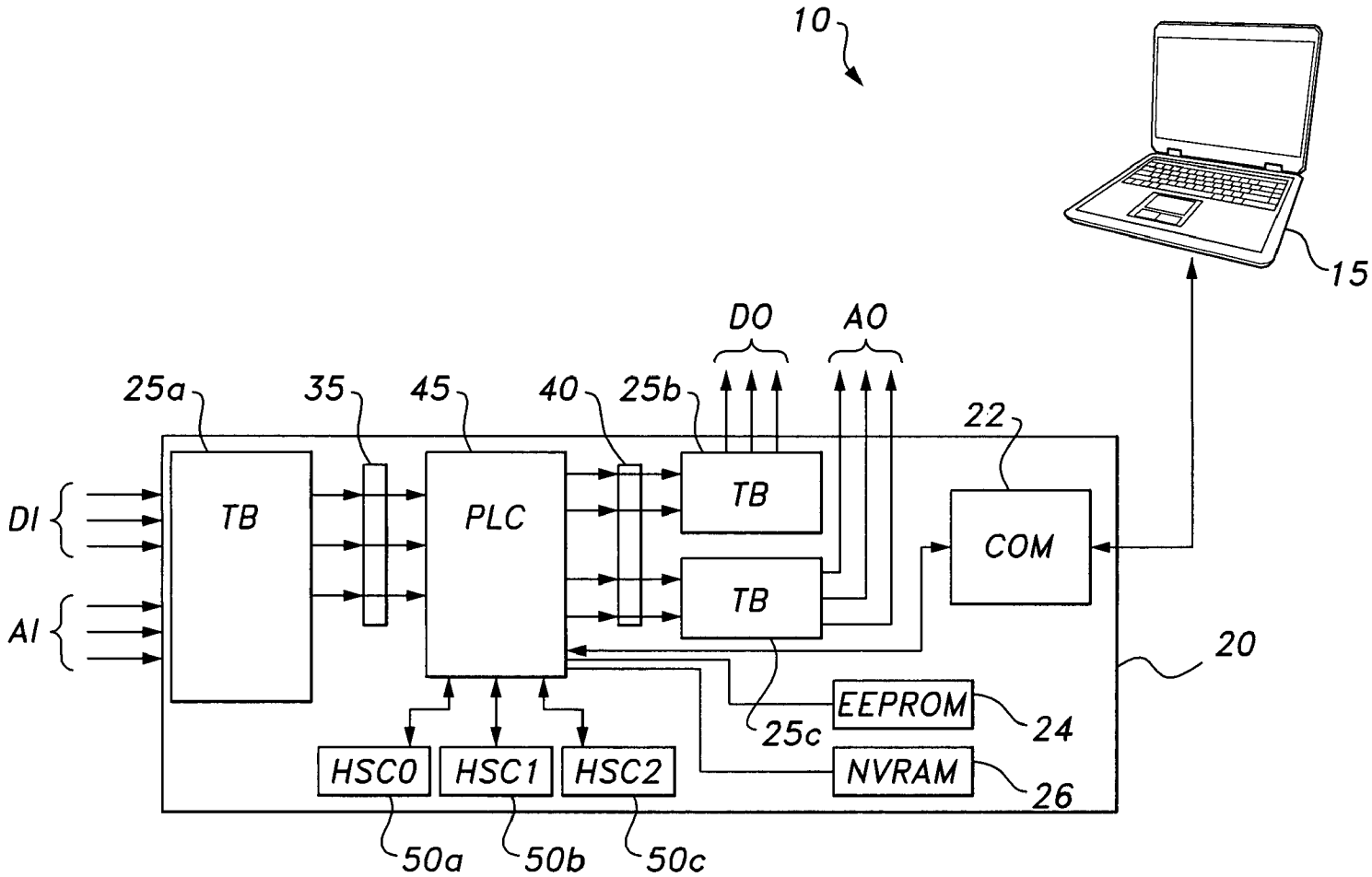
FIG. 3 is a diagrammatic view of the net oil computer of a well test system according to the present invention.

A NOC control panel 3 (shown in FIG. 1) has a plurality of function keys 4*a*, a plurality of screen navigation keys 5 and a plurality of number entry keys 6 that allow a user to initiate well test and control operations. As most clearly shown in FIG. 2, a home screen 7 in display area of the control panel identifies function keys 4 that control well setup (F1), current data (F2), test data (F3), meter factor (F4), test control and status (F5). As shown in FIG. 3 the NOC 10 includes a NOC configuration computer 15 and a NOC controller block 20.

The well test system 10 includes configuration and operational software that configures the computer to collect instrumentation data from a plurality of wells and operates well processes based on the collected instrumentation data. The configuration software is generally available from an external computer such as NOC configuration computer 15. The exemplary NOC configuration computer 15 shown is a laptop computer having its own mass storage unit, data entry and display capabilities.

A cable can connect the NOC configuration computer 15 to a COM port 22 within the NOC 20 of well test system 10. Alternatively the connection of the NOC 20 to external systems may be wireless. The NOC 20 may include a plurality of terminal blocks, at least one data input terminal block 25*a*, and at least one data output terminal block, such as digital output terminal block 25*b*. An analog output terminal block 25*c* may also be provided. Digital and/or analog inputs from well test instrumentation such as flow meters, water-cut meters, and the like may be routed from terminal block 25*a* to an input module 35 that conditions the input signals and routes them to a programmable logic controller (PLC) 45. PLC 45 executes operational software for testing and controlling a plurality of wells.

The operational software may be stored in a read only memory, such as, e.g., electrically erasable programmable read only memory (EEPROM) 24. NOC configuration parameters sent from the NOC configuration computer 15 may also be stored in EEPROM 24. Nonvolatile random access memory NVRAM 26 may be used by PLC 45 to store calculations and various transient data, operands, or the like, during well test and control operations. A plurality of high speed counters 50 are connected to PLC 45 and are designed to be compatible with millivolt level turbine meters and/or test instrumentation devices that provide high level digital outputs from open collector/drain output amplifiers.

Operational software may comprise high level programming instructions, such as, e.g., C++, and/or ladder instructions exemplified by, for example, the industrial automation standards embodied in Programmable Controllers Standard International Electrotechnical Commission (IEC) 61131-3.

An output module 40 routes digital outputs from the PLC 45 to well test instrumentation, well control valves, and the like via digital output terminal block 25*c*. Analog outputs generated by PLC 45 are routed by the output module 40 to well test instrumentation and valves via analog output terminal block 25*c*.

Figure 4:
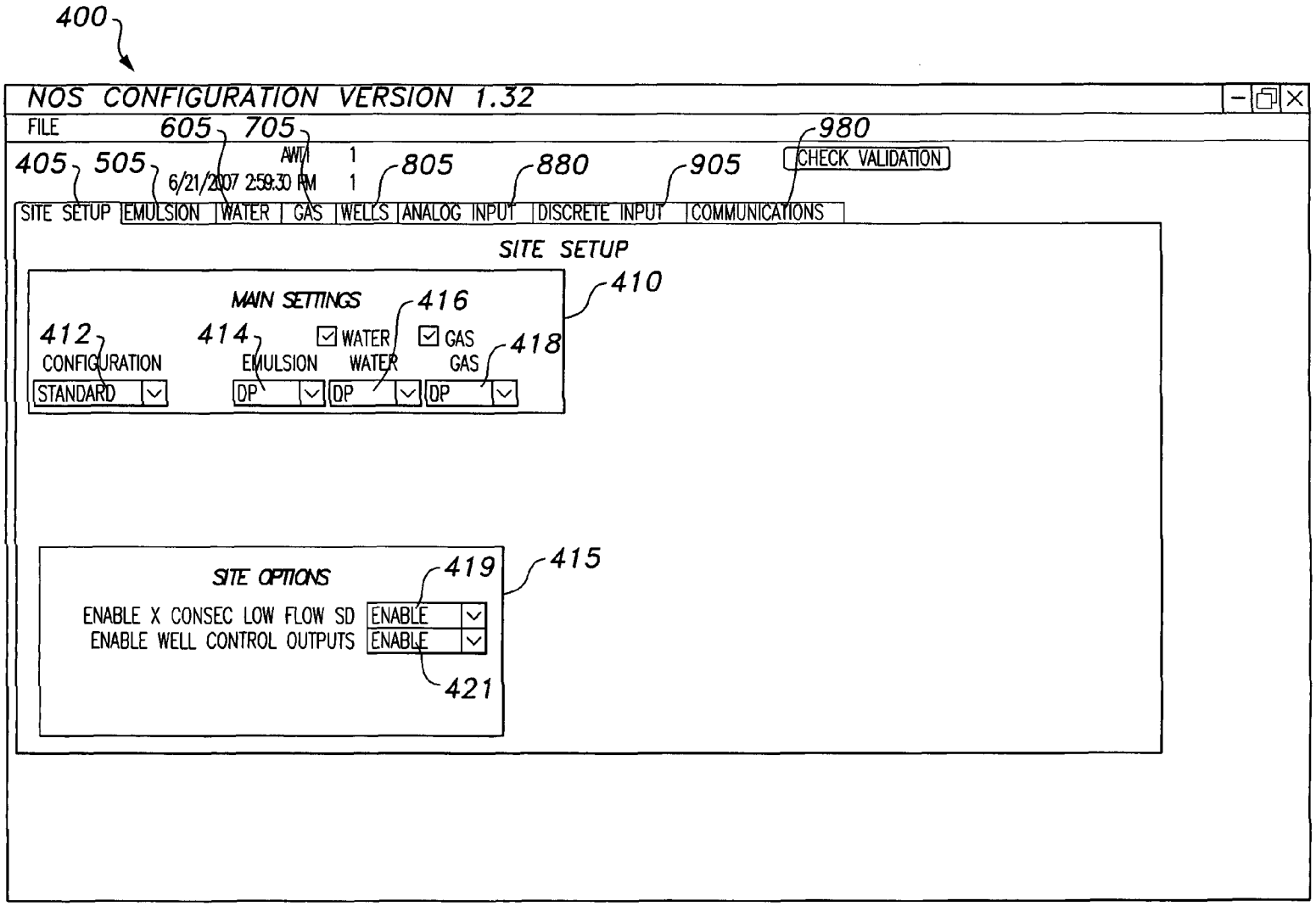
FIG. 4 is a screen shot of the site setup configuration screen in a well test system according to the present invention.

The configuration software executing programmed instructions on configuration computer 15 has a plurality of screens and associated data entry fields that a user populates for download of the entered data to the NOC processor board 20. As shown in FIG. 4, a site setup screen 400 is presented to the user. The site setup screen 400 has a plurality of tabs, which include a Site Setup tab 405, an emulation tab 505, a water tab 605, a gas tab 705, a wells tab 805, an analog input tab 880, a discrete input tab 905, and a communications tab 980.

A configuration pull down menu 412 is provided within a main settings area 410 on the site setup screen 400. Pull down options include Standard, Multi well test, and 24 Hour test. As known by a person having ordinary skill in the art, regardless of mode, a test configuration includes a test portion and a purge portion.

The standard test option is for a single well or steam measurement where the test is manually started and automatically stopped. Test results are logged at the end of the test time. The test time is adjustable. Purge time or purge volume are adjustable. The multi well test configuration option allows for up to sixty-four test well/steam sources.

The 24-hour test is a manual well test that allows for testing of a single well or stream. Manual start capability is provided in the 24-hour manual well test configuration. Test results are logged for individual wells. A manual stop capability is provided. The emulsion pull down menu 414 allows the user to select a flow meter type. The selectable flow meter types offered by pull down menu 414 include differential pressure (DP), positive displacement (PD), turbine, V cone, and Coriolis.

Water and gas checkboxes are provided for user selection of water and/or gas flow meter types. Water flow meter type pull down menu 416 and gas flow meter type pull down menu 418 offer differential pressure (DP), positive displacement (PD), turbine, V cone, and Coriolis meter selection.

In a site options screen area 415, the user is provided with the options to enable or disable an "X Consec Low Flow SD" 419, and enable or disable well control outputs 421.

Figure 5:
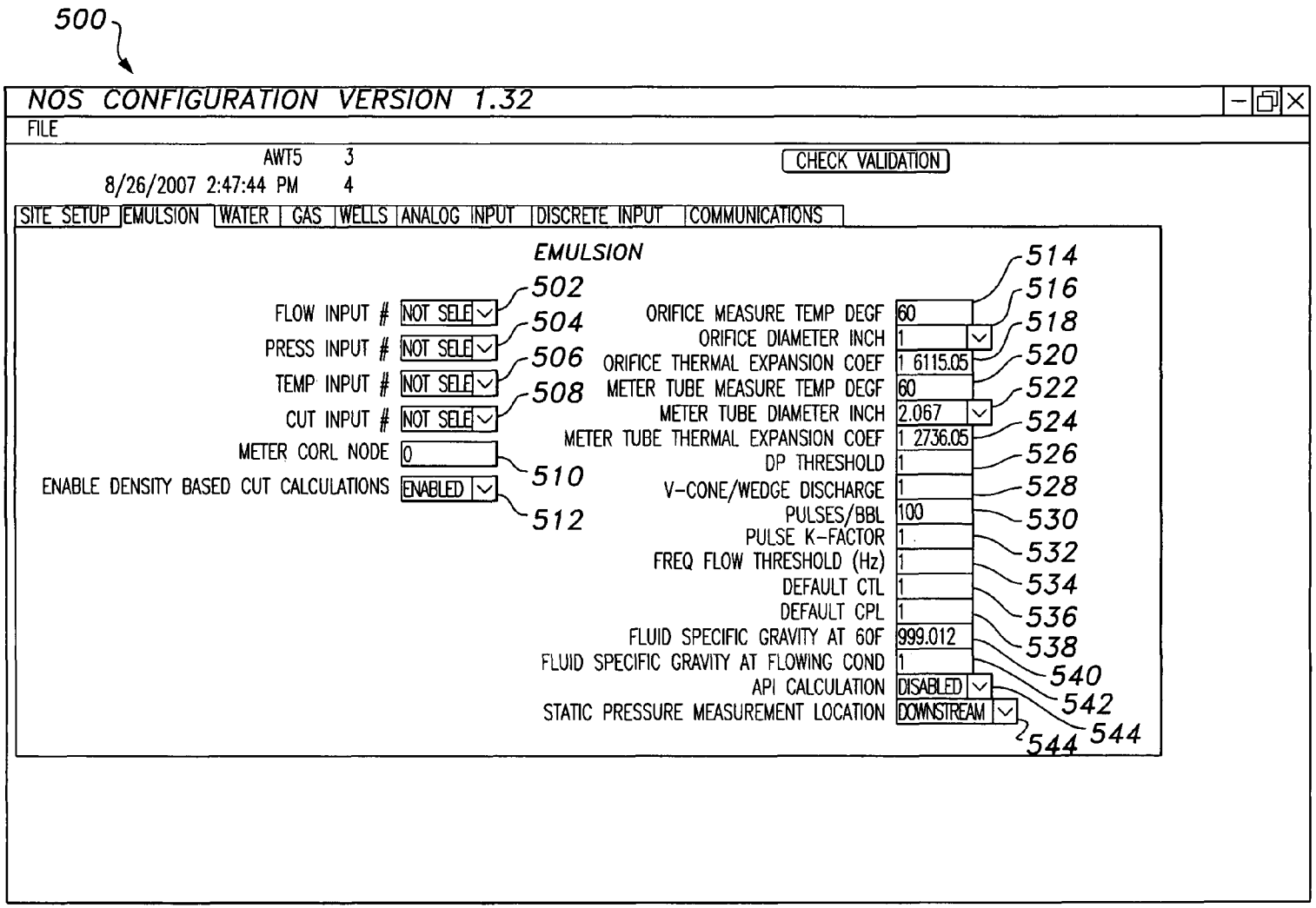
FIG. 5 is a screen shot of the emulsion configuration screen in a well test system according to the present invention.

Referring now to FIG. 5, the emulsion screen 500 provides the user a means for selecting which measurement devices are to be used to measure an emulsion stream. As is well known by persons having ordinary skill in the art, an emulsion stream is a technique that mixes an emulsifying agent, i.e., water with a target fluid, i.e., oil and pumps the combination to the well head with the expectation that resultant production of the target (oil) will be enhanced. Instrumentation devices for emulsion stream measurements are varied and disparate.

To make these varied devices compatible with the NOC 20, the options presented on emulsion screen 500 allow the user to customize the NOC 20 for specific emulsion measurement devices found in a target production field. For each well test device an analog input number must be assigned. For example, flow input number field 502, Pressure Input number pull down menu 504, Temp Input number pull down menu 506, Cut input number 508, Meter Corl Node field 510, and Enable Density Based Cut Calculations enable/disable pull down menu 512 are provided so that the user can assign inputs for the instrumentation connected to the well thereby enabling data returned to the NOC 10 by the test instrumentation to be properly routed for accurate emulsion volume calculations. It should be noted that required fields may change depending on user changes made in the site setup screen 400. Field cells in the emulsion screen area that are not darkened require inputs for proper measurement calculations by the NOC 10.

The emulsion screen 500 also provides a variety of user input parameters necessary for the emulsion calculation. Examples of the required parameter fields are, Orifice Measurement Temperature (deg. F.) 514, Orifice Diameter (inches) 516, Orifice Thermal Expansion Coefficient 518, Meter Tube Measure Temp (deg F) 520, Meter Tube Diameter (inch) 522, Meter Tube Thermal Expansion Coefficient 524, DP threshold 526, V-Cone wedge Discharge 528, Pulses per Barrel 530, Pulse K Factor 532, Frequency Flow Threshold (HZ) 534, Default CTL 536, Default CPL 538, Fluid Specific Gravity at 60° F. 540, Fluid Specific Gravity at Flowing Cond 542, API Calculation Enable/Disable 544, and Static Pressure Measurement Location 546. When the API (American Petroleum Institute) calculation is enabled the NOC 20 utilizes the well test instrumentation data inputs to calculate the oil density relative to the density of water under the observable test conditions in the well. This information results in an API gravity number that can be used to evaluate the oil under test as being light, medium or heavy.

Figure 6:
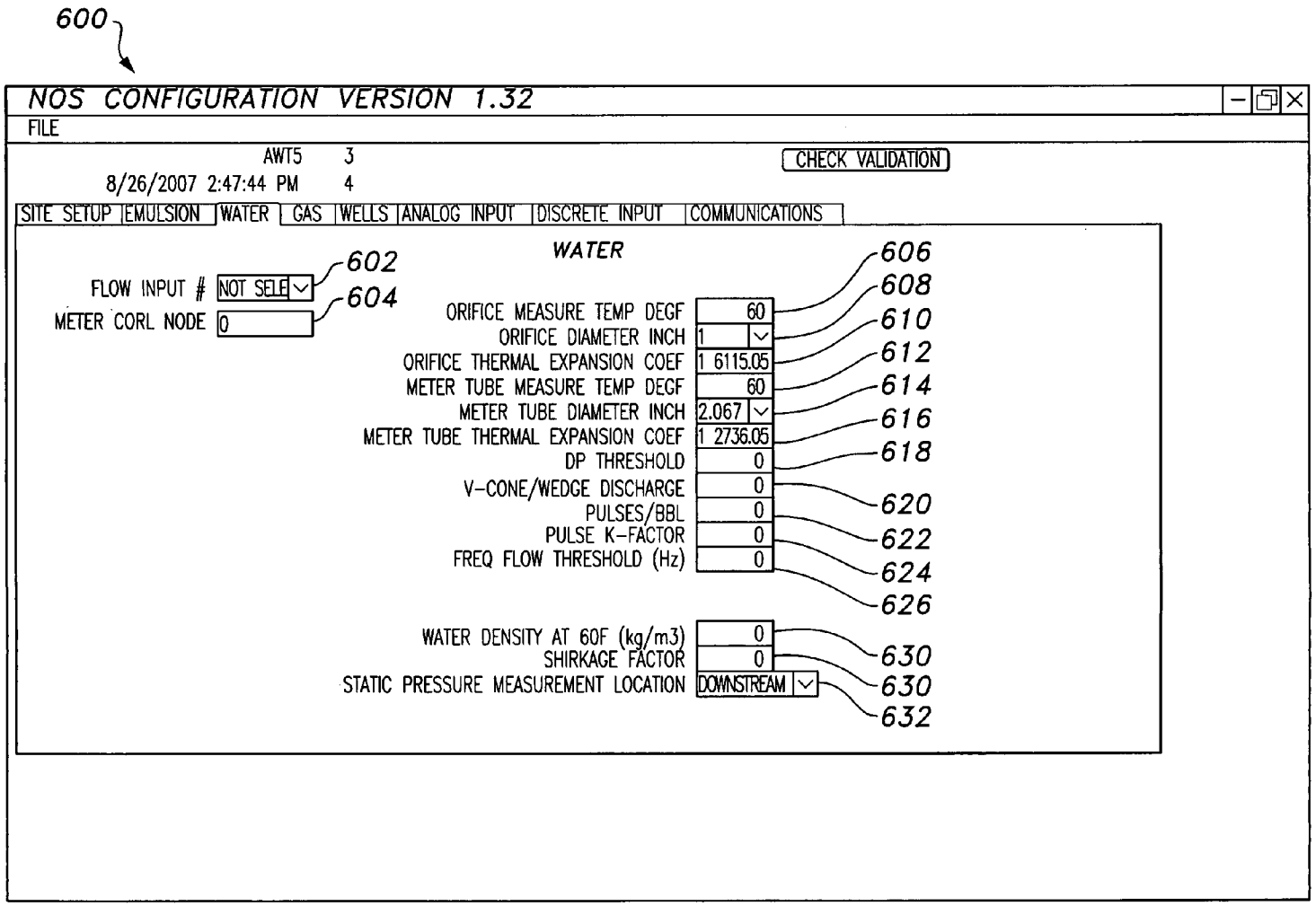
FIG. 6 is a screen shot of the water configuration screen in a well test system according to the present invention.

As shown in FIG. 6, the water screen 600 provides NOS configuration fields based on the water measuring end device chosen in the setup screen 400. An end device screen area includes analog input assignment selection field 602 and Meter Corl Node 604 for the water measurement device. A parameter screen area includes fields for parameters that the user can input for use by the NOS 10 in the water volume calculation formulas. Exemplary water parameter fields include, Orifice Measure Temp (Deg F) 606, Orifice Diameter (Inch) 608, Orifice Thermal Expansion Coefficient, 610, Meter Tube Measure Temp (deg F) 612, Meter Tube Diameter (inch) 614, Meter Tube Thermal Expansion Coefficient 616, DP threshold 618, V-Cone wedge Discharge 620, Pulses per Barrel 622, Pulse K Factor 624, Frequency Flow Threshold (HZ) 626, Water Density (kg/m$^3$) at 60° F. 628, Shirkage Factor 630, and Static Pressure Measurement Location 632. Required input fields in the water column will change if a different device is chosen in the site setup screen water drop down box. Each cell under the water column that is not darkened requires an input for proper measurement.

Figure 7A:
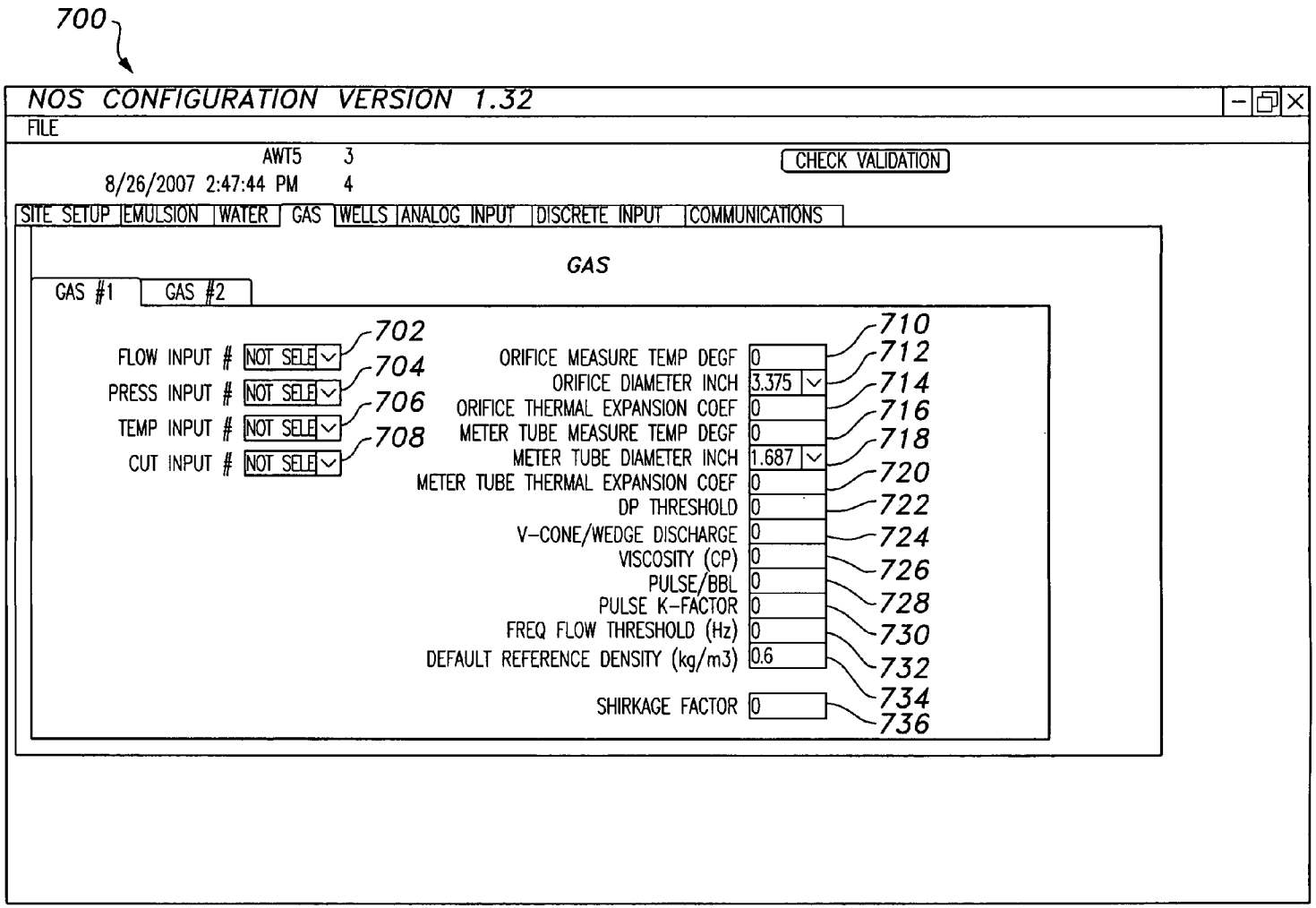
FIG. 7A is a screen shot of the Gas page 1 configuration screen in a well test system according to the present invention.

As shown in FIG. 7A, a first Gas screen 700 provides NOS configuration fields based on the gas measuring end device(s) chosen in the setup screen 400. An end device screen area includes Flow analog input assignment selection field 702, Pressure analog input assignment selection field 704, Temperature analog input assignment selection field 706 and Meter Corl Node 708 for the gas measurement device(s). A parameter screen area includes fields for parameters that the user can input for use by the NOS 10 in the gas volume calculation formulas. Exemplary gas parameter fields include, Orifice Measure Temp (Deg F) 710, Orifice Diameter (Inch) 712, Orifice Thermal Expansion Coefficient, 714, Meter Tube Measure Temp (deg F) 716, Meter Tube Diameter (inch) 718, Meter Tube Thermal Expansion Coefficient 720, DP threshold 722, V-Cone wedge Discharge 724, Pulses per Barrel 728, Pulse K Factor 730, Frequency Flow Threshold (HZ) 732, Default Reference Density (kg/m$^3$) 734, and Shirkage Factor 736.

Figure 7B:
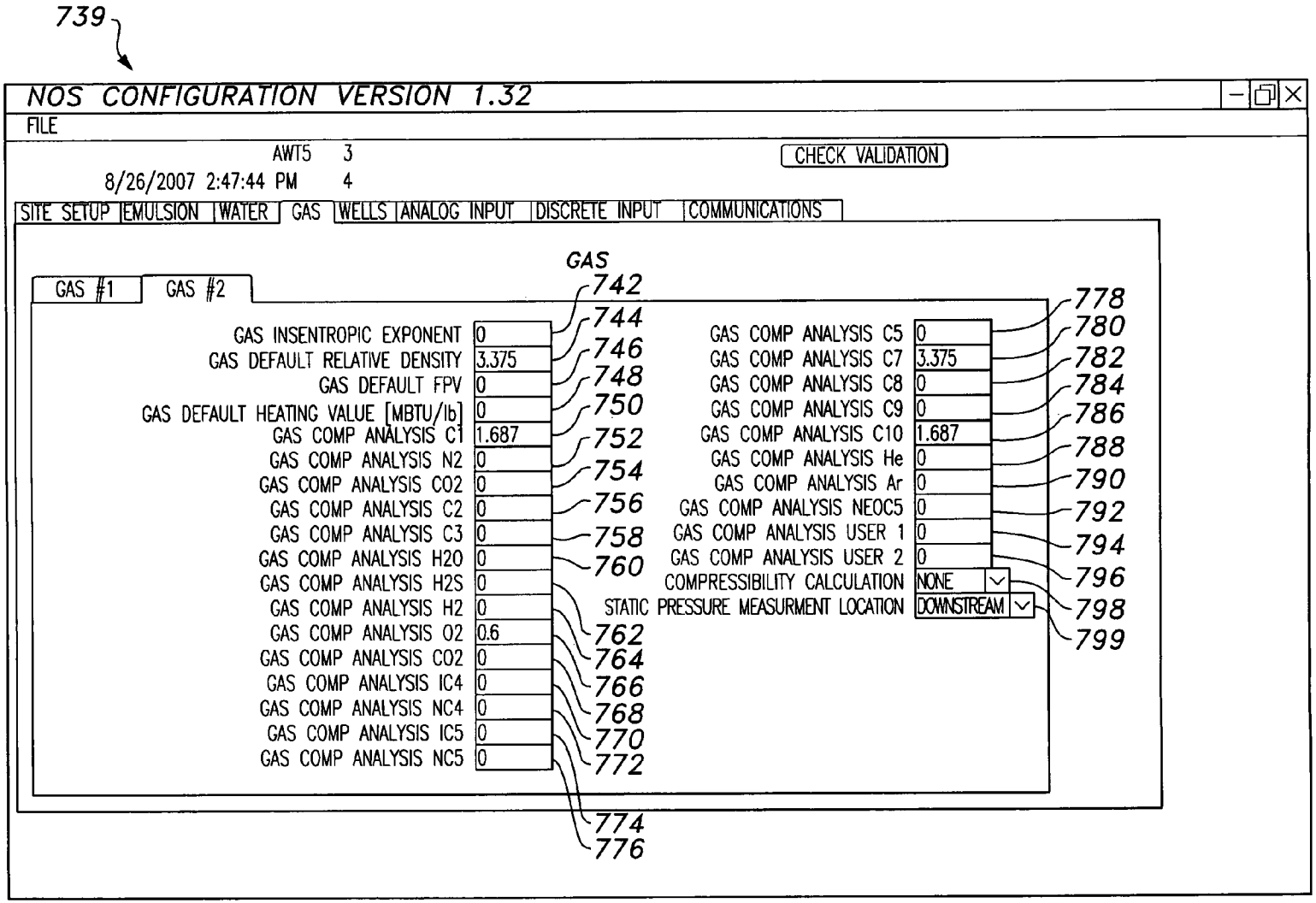
FIG. 7B is a screen shot of the Gas page 2 configuration screen in a well test system according to the present invention.

As shown in FIG. 7B, a second Gas screen 739 provides a parameter screen area that includes fields for additional parameters that the user can input for use by the NOS 10 in the gas volume calculation formulas. Exemplary gas parameter fields on second Gas screen 739 include, Gas Isentropic Exponent 742, Gas Default Relative Density 744, Gas Default $F_{pv}$, 746, Gas Default Heating Value (MBTU/Ib) 748, Gas Comp Analysis C1 750, Gas Comp Analysis N2 752, Gas Comp Analysis CO2 754, Gas Comp Analysis C2 756, Gas Comp Analysis C3 758, Gas Comp Analysis H2O 760, Gas Comp Analysis H2S 762, Gas Comp Analysis H2 764, Gas Comp Analysis O2 766, Gas Comp Analysis CO2 768, Gas Comp Analysis IC4 770, Gas Comp Analysis NC4 772, Gas Comp Analysis IC5 774, Gas Comp Analysis NC5 776, Gas Comp Analysis C6 778, Gas Comp Analysis C7 780, Gas Comp Analysis C8 782, Gas Comp Analysis C10 786, Gas Comp Analysis HE 788, Gas Comp Analysis AR 790, Gas Comp Analysis neoC5 792, Gas Comp Analysis User 1 794, Gas Comp Analysis User 2 796, Compressibility Calculation (None, Enable AGAR, Enable NX19) 798, and Static Pressure Measurement Location (Upstream/Downstream, 799.

Figure 8:
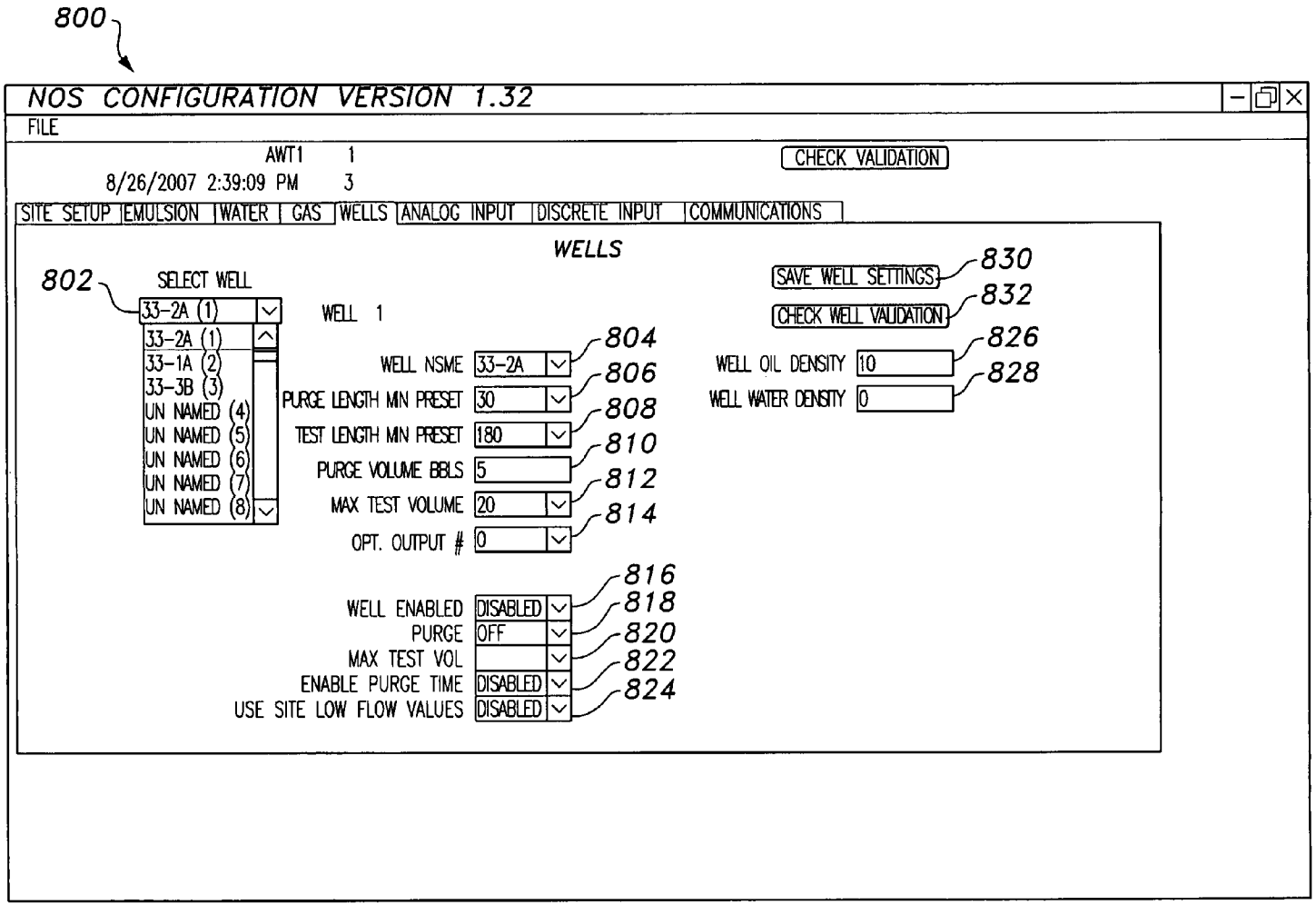
FIG. 8 is a screen shot of the wells configuration screen in a well test system according to the present invention.

As shown in FIG. 8, the wells screen 800 provides NOS configuration fields that a user can enter to identify a plurality of wells and associate purge and test settings for each well. In the well selection area 802, the user can choose a position number for each well assigned to the NOS 10. The user enters a well name in Well Name field 804. Purge length minimum preset field 806, test length minimum preset 808, Purge Volume BBLS field 810, Max Test Volume 812, and Opt output number 814 accept numeric input from the user. Selection pull down menus available are Well enabled/disabled field 816, Purge on/off 818, Max Test Volume 820, Enable/Disable Max Purge Time 822, and Use Site Low Flow Values (enable/disable) 824. Pushbutton 830 allows the well settings to be saved. Pushbutton 832 activates a well validation check. The user can enter well oil density and well water density in fields 826 and 828, respectively.

Figure 9:
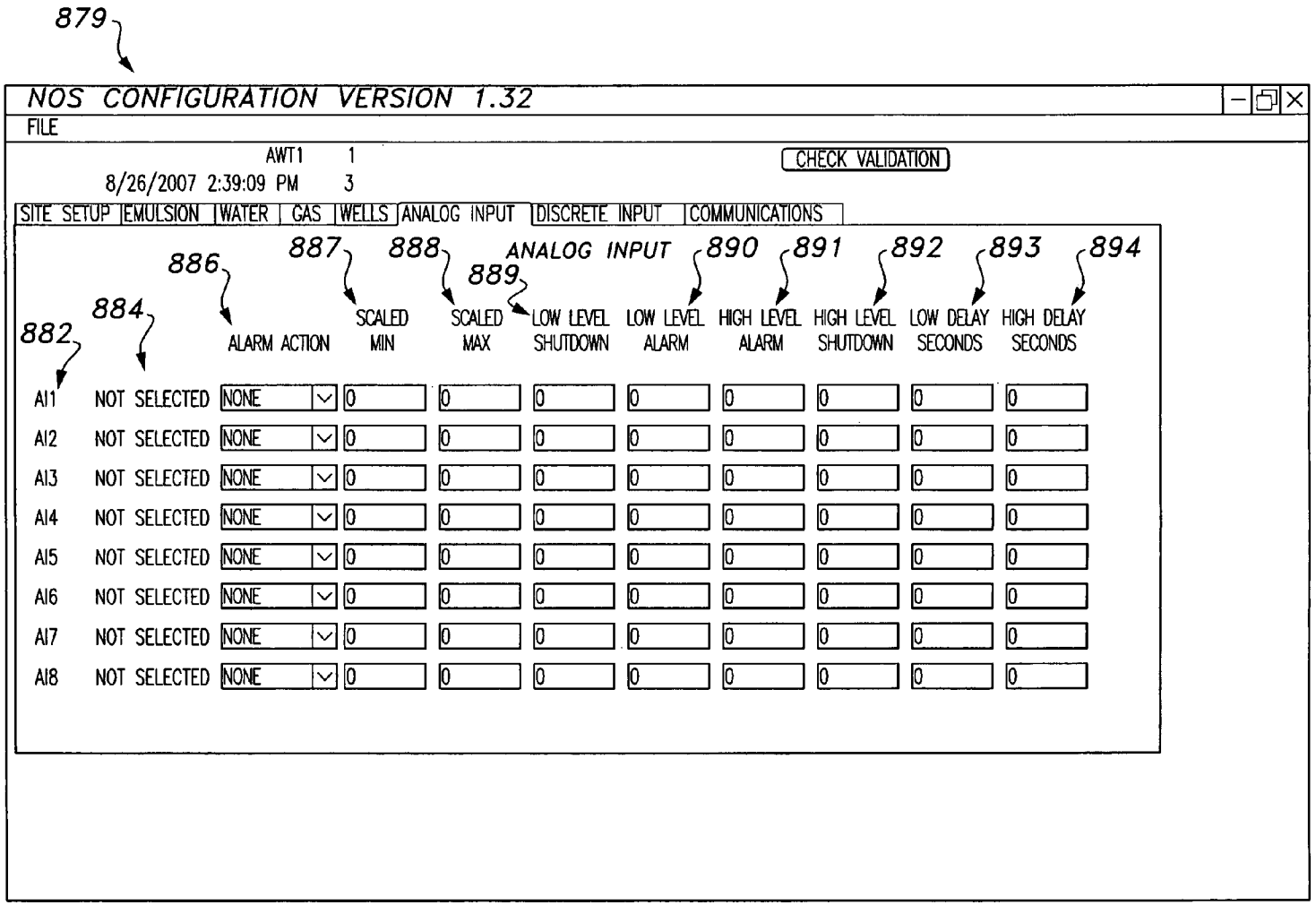
FIG. 9 is a screen shot of the analog input configuration screen in a well test system according to the present invention.

As shown in FIG. 9, the analog input screen 879 includes fields in several screen areas that accept selections and data inputs from the user. The first column 882 indicates which analog input the selection row applies to. If no alarm action is selected, field 884 will indicate "NOT SELECTED". Alarm actions selectable by the user in field 886 include NONE, meaning that no action is taken, the alarm is informational only. SUSPEND action causes the well test to be suspended and causes all wells to be returned to the production stream. The operator can decide what action to take with a well test after the alarm has been cleared. ABORT action aborts the current test and starts the next test. ABORT AND SHUTDOWN—aborts the current well test and shuts the site down.

The user must select scaling values for each input. For each analog input in column 882 the user will be able to select what raw format they are using, either 1 to 5 volts or 4 ma to 20 ma. This will be selected by setting a hardware jumper on the unit. The user must then select the scaled value, i.e., 4 ma=0, 20 ma=200.

Column 887 allows user entry of a desired scaled minimum. Column 888 allows user entry of a desired scaled maximum. Column 889 allows the user to enter a desired low level shutdown value. This is a user-selected number that will cause an alarm to be generated and, depending on what was selected in alarm action, may abort or shut down the test when the scaled value reaches this level. Similarly column 892 is a High level shut down field which allows the user to select a number that will cause an alarm to be generated and, depending on what was selected in alarm action, may abort or shut down the test when the scaled value reaches the level specified in the High level shut down field.

Field 890 allows user entry of a Low level alarm value. This user selected number will cause an alarm to be generated when the scaled value reaches the level specified in Field 890. Field 891 allows user entry of a High level alarm value. This user selected number will cause an alarm to be generated when the scaled value reaches the level specified in Field 891. Each input alarm Analog or Discrete has a corresponding delay timer value. Each analog input. has a low and high alarm timer. Each discrete input. has only one delay timer. Field 893 allows user entry of a low delay timer value (in seconds) associated with low level alarms. The low delay timer value represents the seconds the low level alarm condition has to be true before the alarm occurs. Field 894 allows user entry of a high delay timer value (in seconds) associated with high level alarms. The high delay timer value represents the seconds the high level alarm condition has to be true before the alarm occurs. For both low delay field 893 and high delay field 894, if the alarm condition is removed before the timer is done, an accumulator is reset. If the delay value entered by the user is less than or equal to zero, on alarm condition, the alarm occurs immediately. After data has been entered, the Check Validation button can be clicked to cause The NOC 20 to validate the input data.

Figure 10:
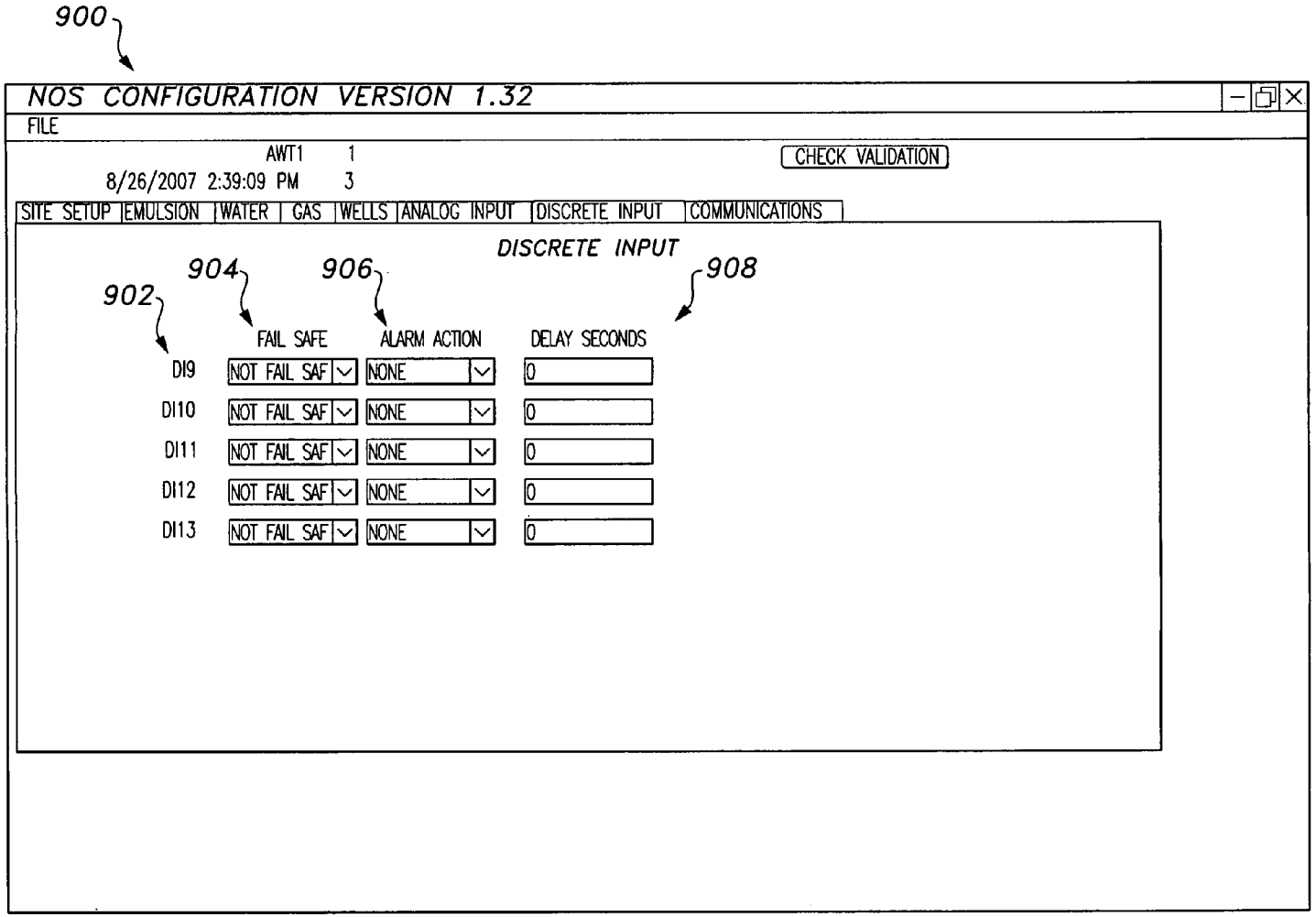
FIG. 10 is a screen shot of the discrete input configuration screen in a well test system according to the present invention.
Figure 11:
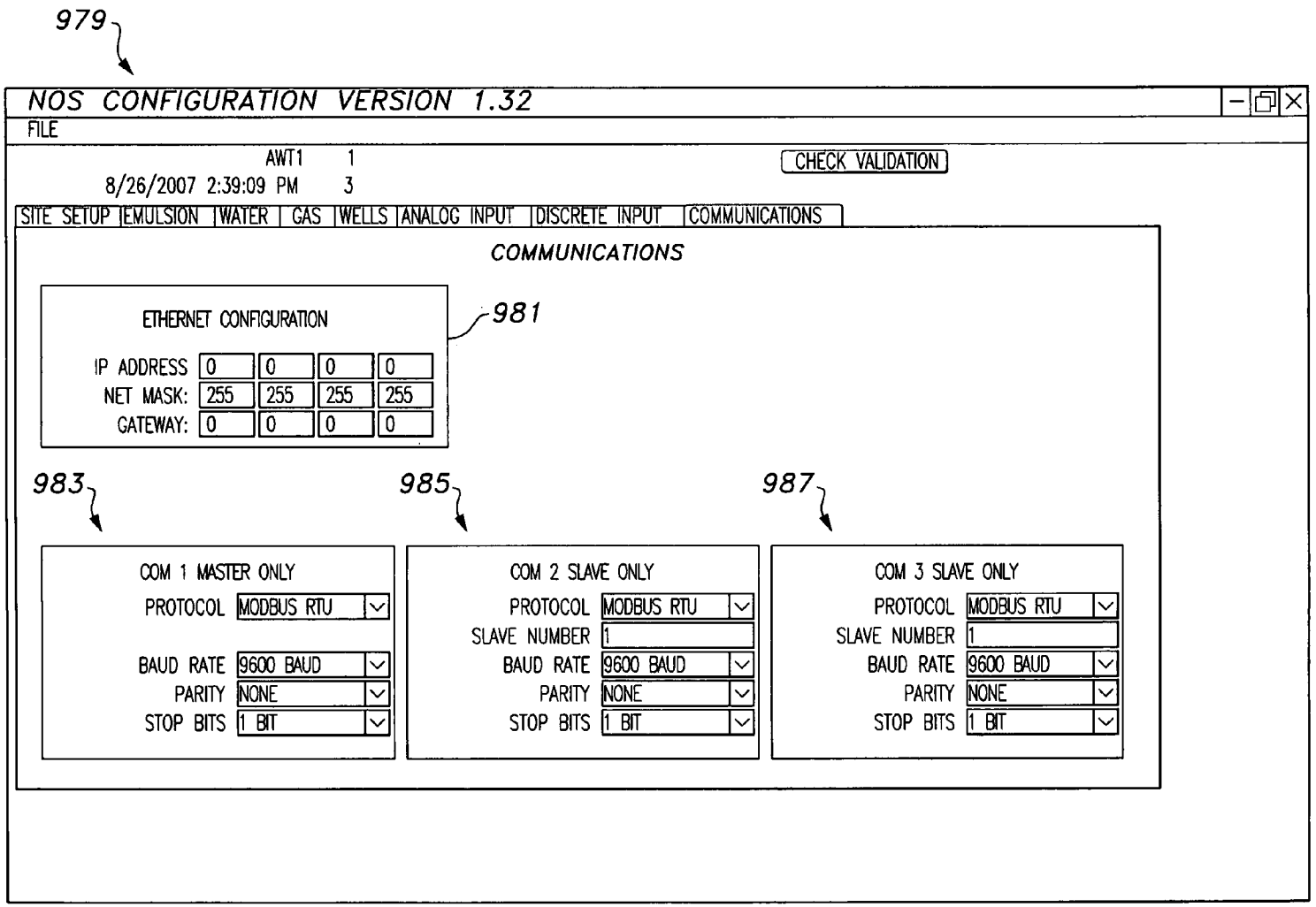
FIG. 11 is a screen shot of the communications screen in a well test system according to the present invention.

As shown in FIG. 10, the discrete input screen 900 includes fields in several screen areas that accept selections and data inputs from the user. DI9 through DI13 in column 902 are discrete alarms that can be used to suspend, abort or shutdown the test. The FAIL SAFE column 904 allows the user to select how the alarm is interpreted. Pull down choices are FAIL SAFE or NOT FAIL SAFE. When a user selects FAIL SAFE, the monitored digital input signal must be lost to indicate an alarm. When a user selects NOT FAIL SAFE the monitored digital input signal must be high or 1 to indicate an alarm. Field 906 allows alarm action to be chosen. Field 908 allows the delay seconds to be chosen.

The Communications screen 979 has an Ethernet configuration area 981 in which an Ethernet IP address can be entered to uniquely identify the NOC 20 and distinguish it from other computers on the Ethernet network. Setting the Subnet Mask enables the network administrator to sub net, i.e., to further divide the host part of the Internet Protocol (IP) address into two or more subnets. Setting the Gateway specifies a node on a network that serves as an entrance to another network. Com 1 configuration area 983 allows setting Protocol Baud rate Parity and Stop bits of a Master NOC 20 unit. Com 2 configuration area 985 allows setting Protocol Baud rate Parity and Stop bits of a first Slave NOC 20 unit that is controlled by the Master unit. Com 3 configuration area 987 allows setting Protocol Baud rate Parity and Stop bits of a second Slave NOC 20 unit that is controlled by the Master unit.

Figure 12:
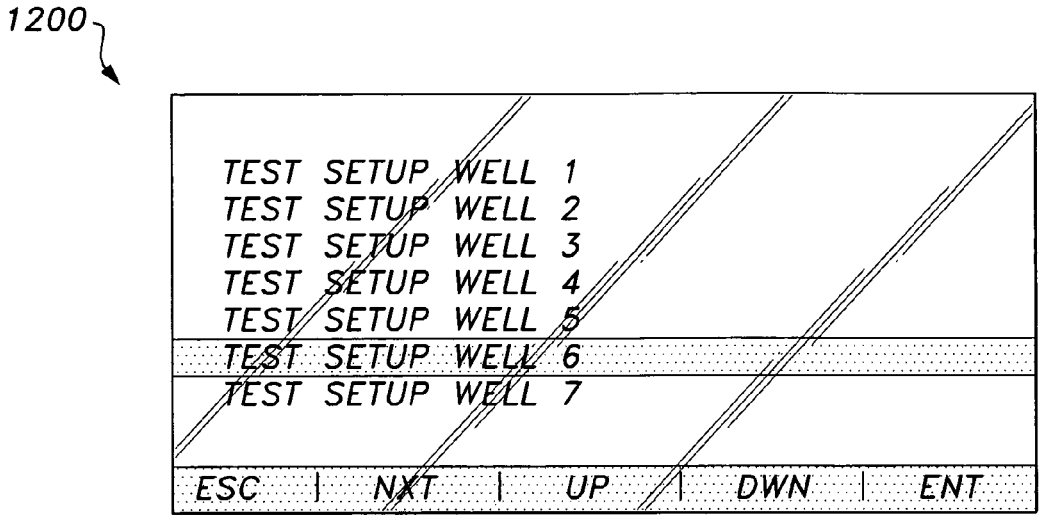
FIG. 12 is a screen shot of the well test setup well selection screen in a well test system according to the present invention.
Figure 13:
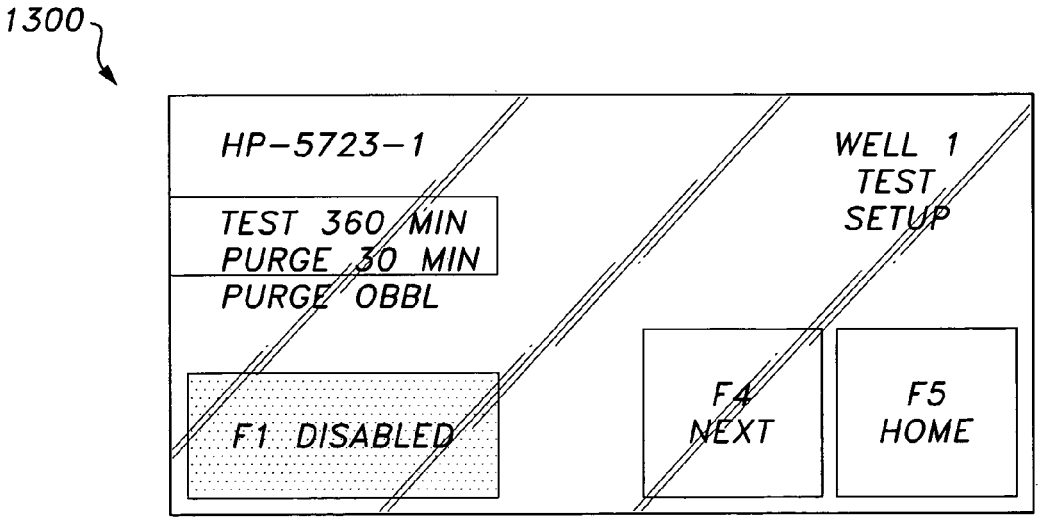
FIG. 13 is a screen shot of the well test setup screen in a well test system according to the present invention.

The NOC 20 has a plurality of interface screens accessible to the user for well test setup, operation, and observation of test results. As shown in FIG. 12, the test setup selection screen 1200 allows the user to select a test setup from a plurality of wells. For example, when TEST SETUP WELL 1 is selected, the WELL 1 TEST SETUP screen (as shown in FIG. 13) is displayed on the NOC unit 20. The well identifier, e.g., HP-5723-1 shows up to identify a particular well that was assigned by the aforementioned configuration software. Test and Purge times can then be entered by the user. Purging on volume can be entered immediately below the Purge time entry. The F1 display identifies a current status (enabled/disabled) of the well test. The F4 and F5 take the user to the next oil well in the sequence or back to the home page, respectively.

Figure 14:
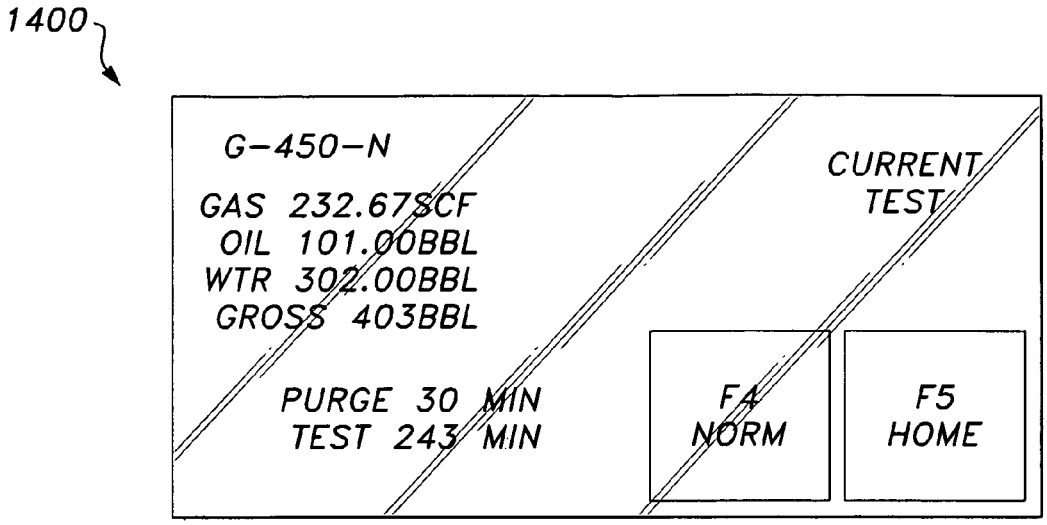
FIG. 14 is a screen shot of the current test screen in a well test system according to the present invention.

An exemplary current test page 1400 is shown in FIG. 14. Exemplary data G-450-N identifies the name of the current well undergoing testing. Test results for GAS, OIL, WATER, and GROSS totals are displayed below the well identifier. The purge and test times are displayed under the totals. Pressing the F4 takes the user into a Normalized Data page.

Figure 15:
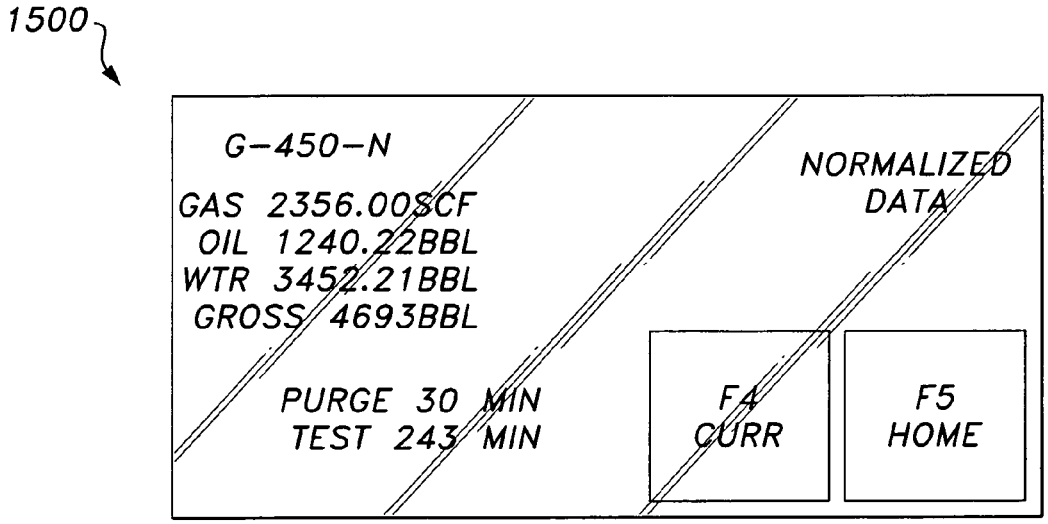
FIG. 15 is a screen shot of the normalized data screen in a well test system according to the present invention.

An exemplary normalized data page 1500 is shown in FIG. 15. The displayed data represents a 24 hour normalization of the test data, utilizing the formula;

{TOTAL MINUTES IN A DAY·1440/CURRENT TEST TIME}×CURRENT VOLUME=NORMALIZED VOLUME

Figure 16:
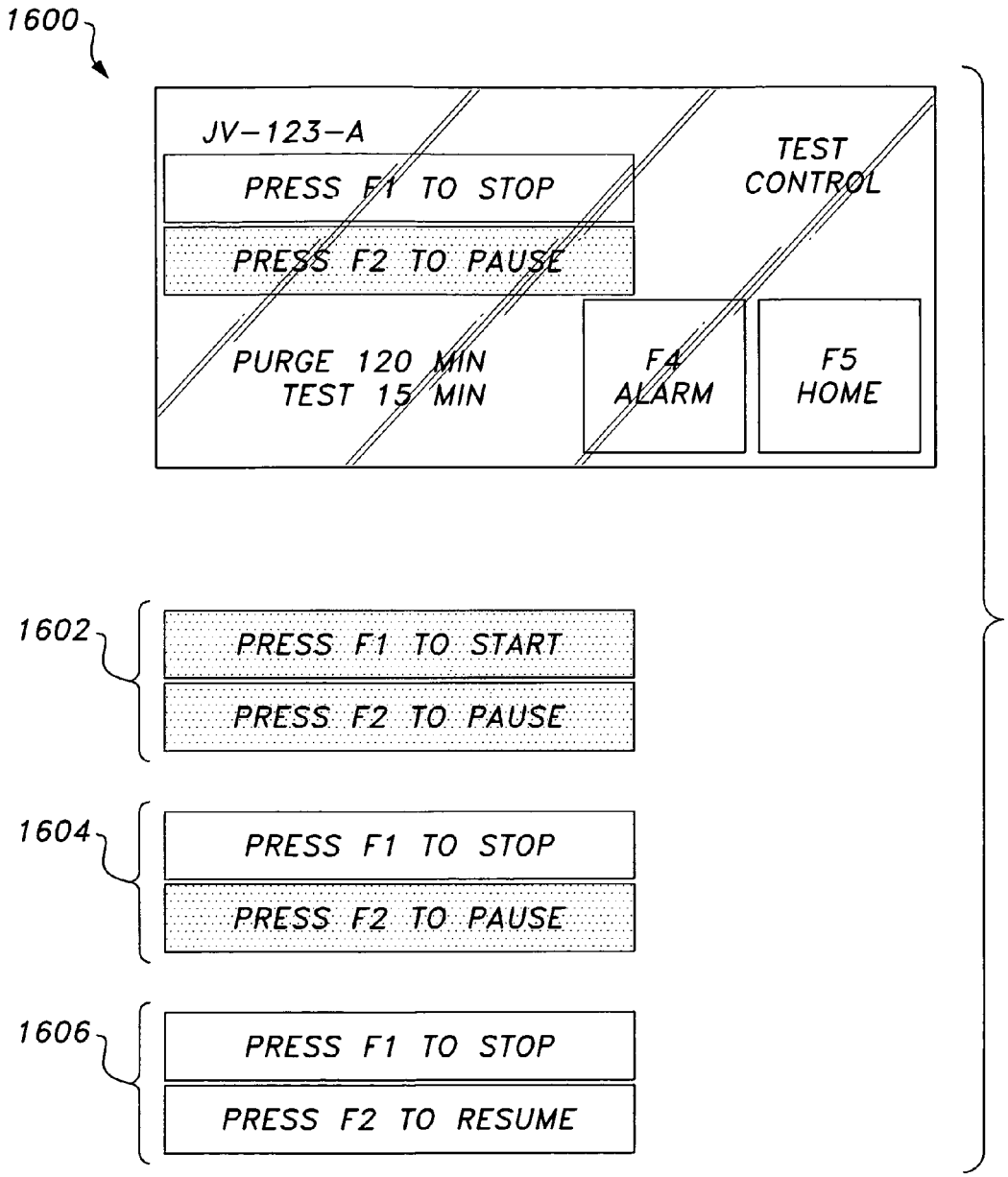
FIG. 16 is a screen shot of the test control and status screen in a well test system according to the present invention.

A test control and status page 1600 is shown in FIG. 16. The displayed data JV-123-A identifies the well under test. The displays of "PRESS F1 TO STOP", and "PRESS F2 TO PAUSE" indicate that the test is running and not paused. The displays shown in 1602 indicate that the test is currently halted. The displays shown in 1604 indicate that the test is running. The displays shown in 1606 indicate that the test is paused and may be resumed by pressing F2.

Figure 17:
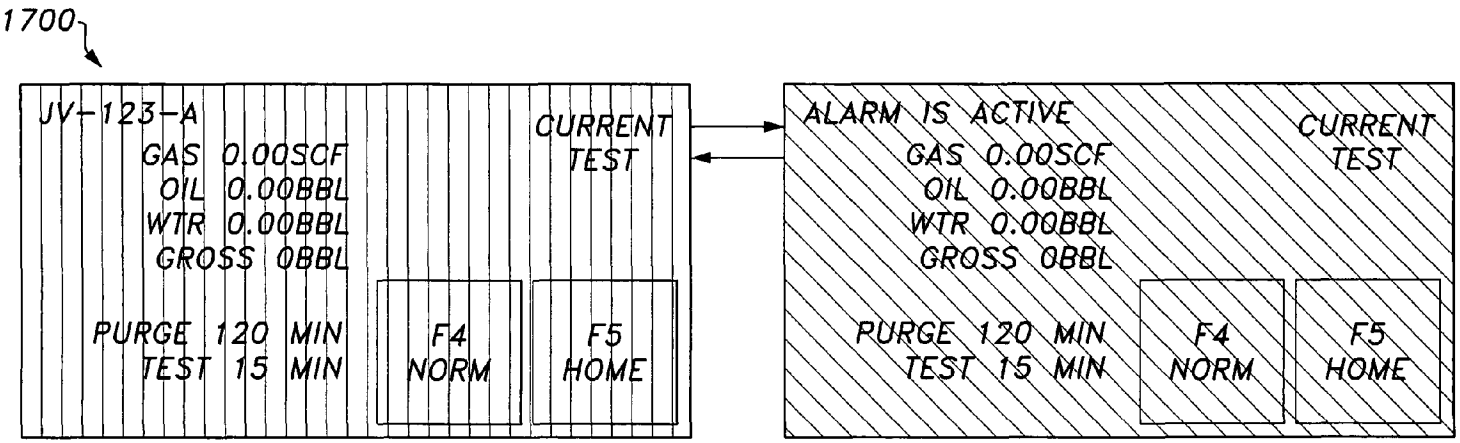
FIG. 17 is a screen shot of the alarms screen in a well test system according to the present invention.
Figure 18:
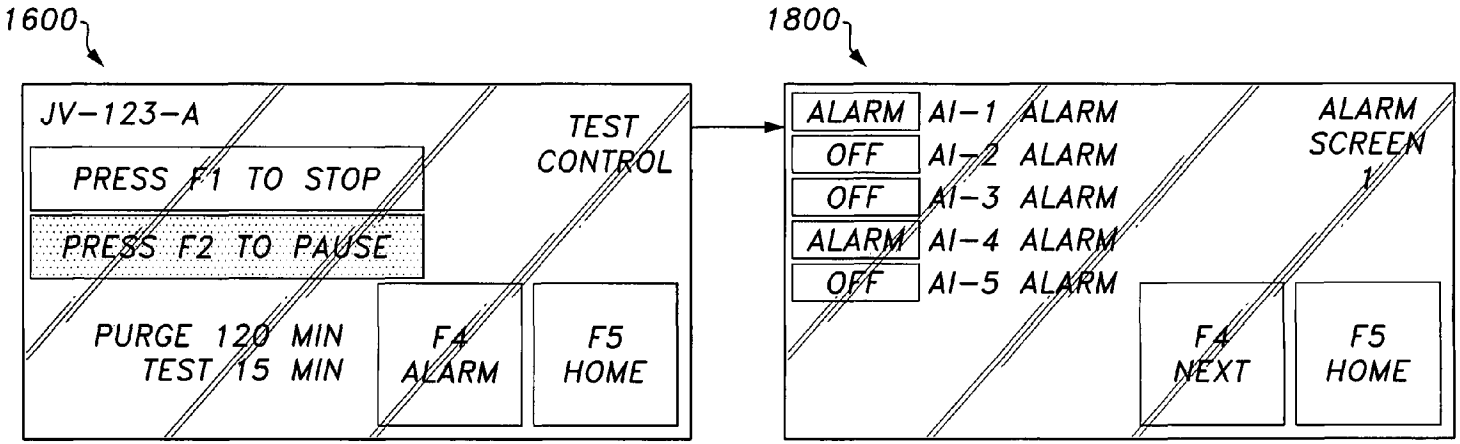
FIG. 18 shows screen shots of navigation through the alarms status screen in a well test system according to the present invention.

FIG. 17 indicates via a flashing (red-green toggling) current test page 1700 that an alarm has been set. As shown in FIG. 18, the user can navigate to the test control page 1600 and press F4 which will then cause the Alarm Screen 1800 to display details about the alarm condition(s).

The well test system 10 is also capable of logging test data and computing a process capability index based on the data. A process capability index uses both the process variability and the process specifications to determine whether the process is "capable". A capable process is one where almost all the measurements fall inside the specification limits.

Process Capability Index is a ratio of the amount of well test gauge data that is within the upper and lower limits set at +/−10%. PCI values are then converted to a Well Test Confidence value between 0 and 100% for all well tests, net oil and gross volume measurements. A calculated Well Test Confidence value for each well can be displayed on the display screen of the NOC 20.

It is to be understood that the present invention is not limited to the embodiment described above, but encompasses any and all embodiments within the scope of the following claims.

We claim:

1. A well test system, comprising:

a programmable logic controller (PLC) adapted for connection to well test sensors and well test control devices;

a net oil computer (NOC) operably connected to the programmable logic controller, the computer having a processor, an area of main memory, and configuration software operable by the processor when loaded into main memory, the configuration software having means for reconfiguring the programmable logic controller to communicate with well test sensors and well control devices having disparate input signal, output signal, and control signal parameters in order to interchange proprietary brands of sensors and control devices; and a plurality of high speed counters connected to said PLC said high speed counters being compatible with millivolt level turbine meters and test instrumentation devices having high level digital outputs from open collector/drain output amplifiers.

2. The well test system, according to claim 1, wherein said system is supervisory control and data acquisition (SCADA) compliant.

3. The well test system, according to claim 1, further comprising means for controlling a plurality of individual wells.

4. The well test system, according to claim 3, further comprising:

means for logging test data, thereby providing a historical database; and means for analyzing the test data, thereby formulating "Data Confidence" information based upon the historical data associated with previous tests for each well.

5. The well test system, according to claim 1, further comprising means for sending well data and test results to cell phones.

6. The well test system, according to claim 1, wherein said system comprises means for operability with two-phase and three-phase separators.

7. The well test system, according to claim 1, further comprising means for configuring the net oil computer (NOC) for interface compatibility with the well test sensors and the well control devices.

8. The well test system, according to claim 1, wherein said NOC further comprises means for interfacing with a user, thereby allowing the user to initiate well test and control operations from said NOC.

9. The well test system, according to claim 1, further comprising:

means for configuring alarms based on analog data input from the wells to the well test system; and means for configuring alarms based on discrete data input from the wells to the well test system.

10. The well test system, according to claim 1, further comprising:

means for presenting well test data in a 24-hour normalization format, utilizing the formula:

{TOTAL MINUTES IN A DAY ·1440/CURRENT TEST TIME}×CURRENT VOLUME =NORMALIZED VOLUME.

11. The well test system, according to claim 1, further comprising means for allowing the user to customize the NOC for specific gas measurement devices found in a target production field.

12. The well test system, according to claim 11, further comprising means for allowing input of parameters so that the user can input the parameters for use by the well test system in performing gas volume calculations.

13. The well test system, according to claim 11, further comprising means for allowing a user to identify wells selected from a plurality of wells and for associating purge and test settings for each of the said user-identified wells.

14. The well test system, according to claim 1, wherein further comprising an emulsion pull down menu, allowing the user to select a flow meter type from among differential pressure (DP), positive displacement (PD), turbine, V cone, and Coriolis flow meters.

15. The well test system, according to claim 14, further comprising means for allowing the user to customize the NOC for specific emulsion measurement devices found in a target production field.

16. The well test system, according to claim 15, further comprising means for accepting a variety of user input parameters for an emulsion calculation.

17. The well test system, according to claim 16, further comprising means for evaluating oil under test by the system as being light, medium or heavy.

18. The well test system, according to claim 16, further comprising means for configuring the well test system based on a water measuring end device chosen by the user.

19. The well test system, according to claim 18, further comprising means for accepting water instrumentation parameters input by a user, the water instrumentation parameters being used by the well test system to perform water volume calculations.

20. A well test system, comprising:

a programmable logic controller (PLC) adapted for connection to well test sensors and well test control devices;

a net oil computer (NOC) operably connected to the programmable logic controller, the computer having a processor, an area of main memory, and configuration software operable by the processor when loaded into main memory, the configuration software having means for reconfiguring the programmable logic controller to communicate with well test sensors and well control devices having disparate input signal, output signal, and control signal parameters in order to interchange proprietary brands of sensors and control devices;

means for allowing the user to customize the NOC for specific gas measurement devices found in a target production field; and means for allowing a user to identify wells selected from a plurality of wells and for associating purge and test settings for each of the said user-identified wells.

* * * * *